United States Patent [19]

Wischusen, III

[11] Patent Number: 5,048,749

[45] Date of Patent: Sep. 17, 1991

[54] SEALED RECLOSABLE CONTAINER

[75] Inventor: Henry Wischusen, III, Lilburn, Ga.

[73] Assignee: Rock-Tenn Company, Norcross, Ga.

[21] Appl. No.: 409,528

[22] Filed: Sep. 19, 1989

[51] Int. Cl.[5] ..... B65D 5/42

[52] U.S. Cl. ..... 229/128; 229/8; 229/125.37; 383/98

[58] Field of Search ..... 229/8, 110, 106, 126, 229/159, 193, 125.37, 125.42, 40, 128; 383/98

[56] References Cited

U.S. PATENT DOCUMENTS

| | | | |
|---|---|---|---|
| 359,435 | 3/1887 | Elliott . | |
| 667,634 | 2/1901 | Schmidt . | |
| 1,763,025 | 6/1930 | Wormer | 229/125.42 |
| 1,915,026 | 6/1933 | Meyer-Jagenberg | 229/125.42 |
| 2,067,998 | 1/1937 | Williamson . | |
| 2,137,614 | 11/1938 | Hinkle . | |
| 2,138,700 | 11/1938 | Hoff . | |
| 2,158,097 | 5/1939 | Wentz . | |
| 2,232,088 | 2/1941 | Waters . | |
| 2,508,962 | 5/1950 | Moore | 229/40 |
| 2,669,351 | 2/1954 | Carson . | |
| 2,939,625 | 6/1960 | Snyder | 229/126 |
| 2,964,227 | 12/1960 | Goldsholl . | |
| 2,998,182 | 8/1961 | George | 229/106 |
| 3,125,258 | 3/1964 | Watts . | |
| 3,166,235 | 1/1965 | Schroeder . | |
| 3,343,743 | 9/1967 | Hamilton, Jr. et al. | 229/8 |
| 3,366,312 | 1/1968 | Lewenberg et al. | 229/8 |
| 3,630,430 | 12/1971 | Struble . | |
| 3,637,130 | 1/1972 | Farquhar . | |
| 3,684,157 | 8/1972 | Mendez . | |
| 3,908,888 | 9/1975 | Gordon . | |
| 4,109,848 | 8/1978 | Kipp . | |
| 4,191,323 | 3/1980 | Webinger . | |
| 4,410,129 | 10/1983 | Wischusen . | |
| 4,502,623 | 3/1985 | Moore . | |
| 4,558,815 | 12/1985 | Wischusen . | |
| 4,789,066 | 12/1988 | Lisiecki | 229/125.42 |

*Primary Examiner*—Gary E. Elkins

*Attorney, Agent, or Firm*—Jones, Askew & Lunsford

[57] ABSTRACT

An improved sealing end closure for a "pillow" type paperboard container, according to which end flaps from opposing side panels are sealed together in a unique manner. The invention relates to a reclosable container, and more particularly relates to a pillow-shaped sealed container of paperboard or the like which is suitable for maintaining freshness of snack foods or similar items, and which can be reclosed after opening. In particular embodiments of the invention, the end closure utilizes the locking characteristics of end flaps attached to side panels by arcuate scores in a novel manner in order to provide a container which can be sealed efficiently and inexpensively, and then easily reclosed by repositioning the end flaps without the need for any additional locking mechanism. The end flaps are positioned to meet and form a seal along the transverse centerline of the container end. In one embodiment, tape is used to make the seal. In another embodiment, the seal is made with adhesive, or the container material is lined with a thermoplastic material that is heat sealed.

17 Claims, 5 Drawing Sheets

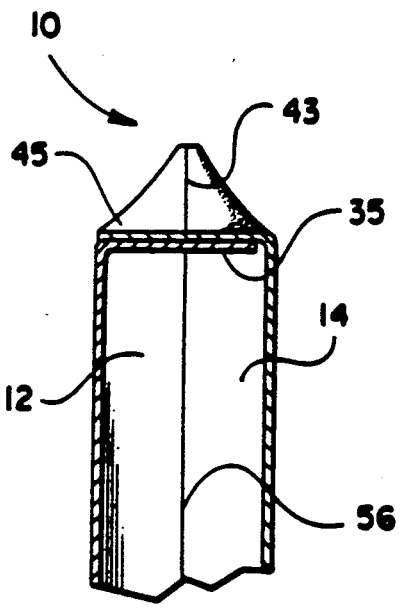
Fig_8
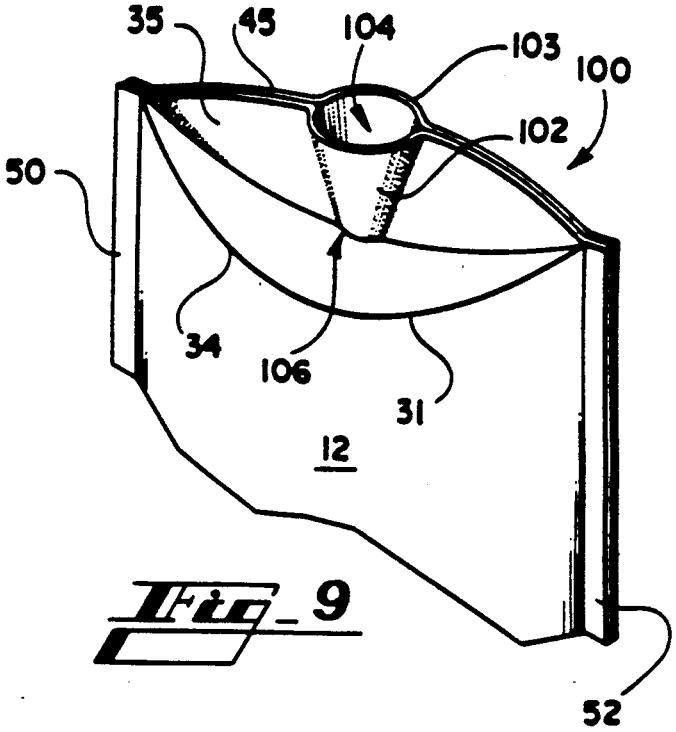
Fig_9
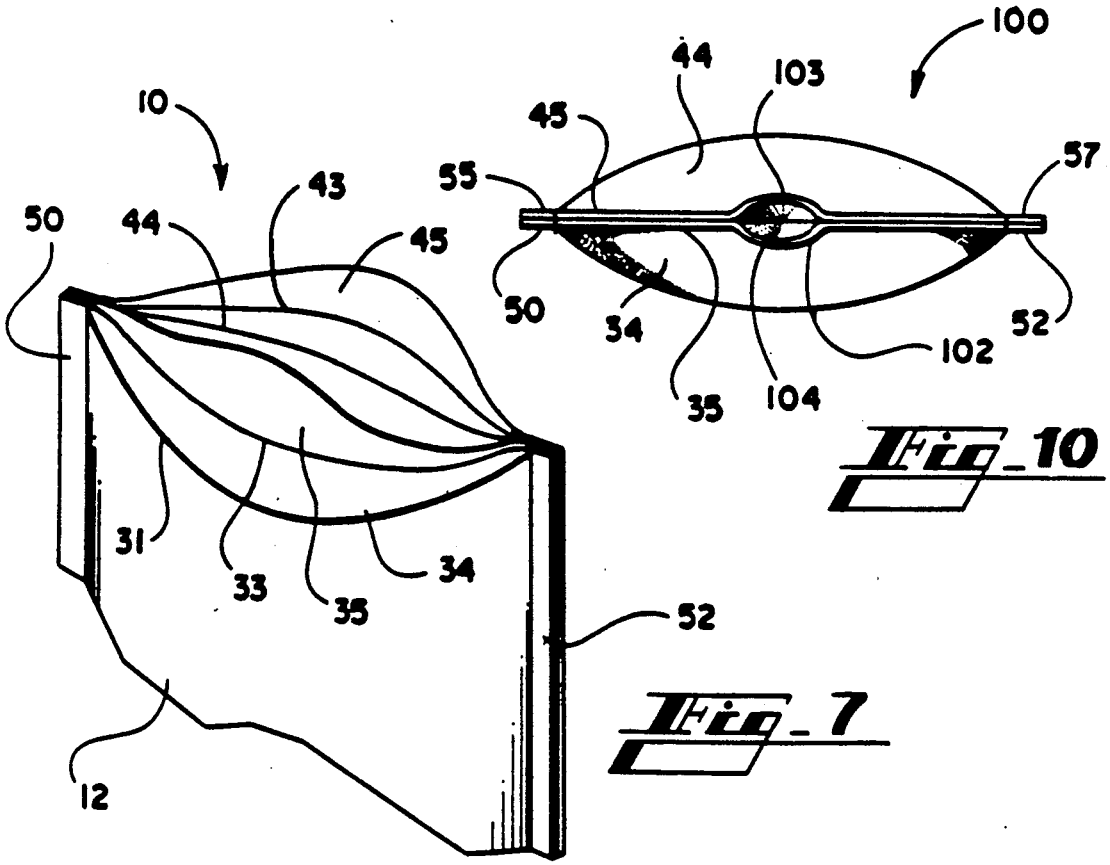
Fig_10
Fig_7

Fig_13
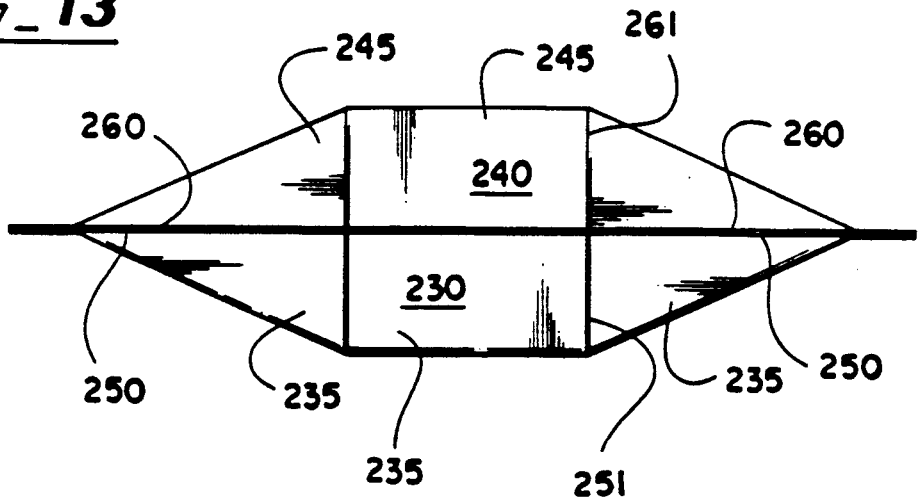
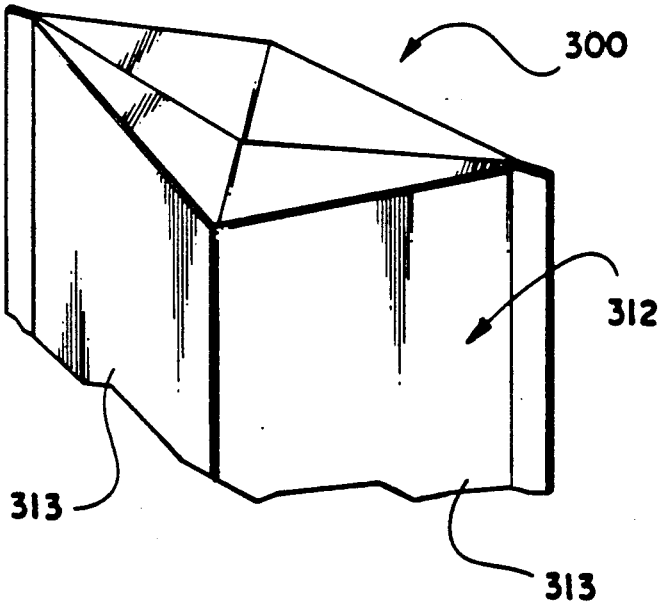
Fig_14
Fig_15
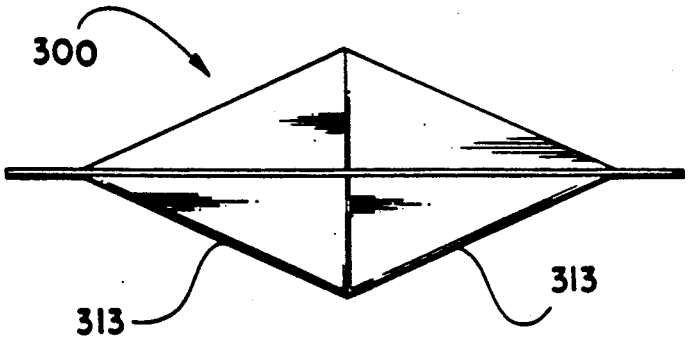

SEALED RECLOSABLE CONTAINER

TECHNICAL FIELD

The present invention relates to a reclosable container, and more particularly relates to a pillow-shaped sealed container of paperboard or the like which is suitable for maintaining freshness of snack foods or similar items, and which can be reclosed after opening.

BACKGROUND ART

Marketers of snack foods have an interest in providing their products in packages that are attractive and capable of preserving the freshness of the product, while remaining relatively inexpensive. A large number of such products are marketed in sealed plastic or foil/-plastic laminate bags. These bags have the disadvantage that they will not stand on their own and must be balanced in rows on shelves or racks in the grocery. In the case of "high density" snack foods, such as those having an outer shell filled with cheese or the like, it is desirable to use a more substantial, higher quality container to fit the more expensive contents.

Paperboard containers suitable for snack foods are known in a variety of configurations. Some are capable of standing alone, such as the containers disclosed in U.S. Pat. Nos. 4,109,848 to Kipp, 2,232,088 to Waters, and 667,634 to Schmidt, the latter having integral cover flaps. The use of arcuate scores connecting end flaps to side panels is known for the purpose of providing reclosable self-locking end closures and for maintaining containers having bowing walls in an erect configuration. Examples of such construction are shown in U.S. Pat. Nos. 3,637,130 to Farquhar, 3,166,235 to Schroeder, 2,964,227 to Goldsholl, and 359,435 to Elliott. The use of arcuate scores to provide curved side or end wall construction is shown in U.S. Pat. Nos. 4,502,623 to Moore, 4,191,323 to Webinger, 3,684,157 to Mendez, 3,630,430 to Struble, 3,125,258 to Watts, and 2,067,998 to Williamson.

Sealed end closures are shown in U.S. Pat. Nos. 3,908,888 to Gordon, 2,158,097 to Wentz, 2,138,700 to Hoff, and 2,137,614 to Hinkle. Other prior patents of interest include U.S. Pat. Nos. 4,558,815 and 4,410,129 to Wischusen and 2,669,351 to Carson.

There has been a need in the art for a sealed, reclosable container in which both the sealing and reclosure mechanisms are easy to use, uncomplicated and inexpensive.

SUMMARY OF THE INVENTION

The present invention provides an improved sealing end closure according to which end flaps from opposing side panels are sealed together in a unique manner. In particular embodiments of the invention, the end closure utilizes the locking characteristics of end flaps attached to side panels by arcuate scores in a novel manner in order to provide a container which can be sealed efficiently and inexpensively, and then easily reclosed by repositioning the end flaps without the need for any additional locking mechanism.

Generally described, the invention provides a container of paperboard, or the like, comprising a pair of side panels positioned to receive contents therebetween; a pair of end flaps each extending from one of the side panels toward the other side panel, each of the end flaps including a central fold line positioned the end flaps, with the central fold lines each defining a pair of outer flap panels outwardly of the fold lines; and means for joining the end flaps together in abutting relationship along the central fold lines with the outer flap panels folded outwardly, whereby the end of the container is sealed.

In the preferred embodiment, the side panels bow outwardly in a smooth curve and meet in a pair of longitudinal side edges, and the end flaps are joined to the side panels along outwardly and downwardly bowing fold lines extending to the side edges, such that after opening of the container, the end flaps may be folded in and locked in place over the end of the container. The means for joining the end flaps together can comprise a length of tape applied across the abutted end flaps along the central fold lines, or means for adhesively joining the abutting end flaps along the central fold lines.

In another embodiment, the outer panels of the end flaps are heat sealed together over a major portion of their area, leaving a cavity defined between the outer panels at the center of the container end, outside the line of sealing.

In yet another embodiment, the side panels are formed from a plurality of component panels foldably connected along fold lines extending parallel to the side edges. The side panels bow outwardly, but not in a smooth curve.

Thus, it is an object of the present invention to provide a container having an improved end closure.

It is a further object of the present invention to provide an improved sealed end closure.

It is a further object of the present invention to provide an improved sealed end closure which can be reclosed into a self-locking configuration.

It is a further object of the present invention to provide an improved sealed end closure that can be opened easily.

It is a further object of the present invention to provide a container which can be sealed efficiently and inexpensively, and then easily reclosed by repositioning end flaps without the need for a complicated locking mechanism.

It is a further object of the present invention to provide a sealed, reclosable container in which both the sealing and reclosure mechanisms are easy to use, uncomplicated and inexpensive.

Other objects, features, and advantages of the present invention will become apparent upon reading the following detailed description of embodiments of the invention, when taken in conjunction with the accompanying drawing and the appended claims.

BRIEF DESCRIPTION OF THE DRAWING

FIG. 7 is a partial pictorial view of a container embodying the invention in an erected, open configuration.

FIG. 8 is a partial cross-sectional view of the container in a reclosed configuration.

FIG. 9 is a partial pictorial view of another embodiment of the invention.

FIG. 10 is a top plan view of the container of FIG. 9.

FIG. 13 is a top plan view of the container of FIG. 11.

FIG. 14 is a pictorial view of another embodiment of the container of FIG. 11, having side panels formed from two component panels.

FIG. 15 is a top plan view of the container of FIG. 14.

DETAILED DESCRIPTION OF THE DRAWINGS

Figure 1:
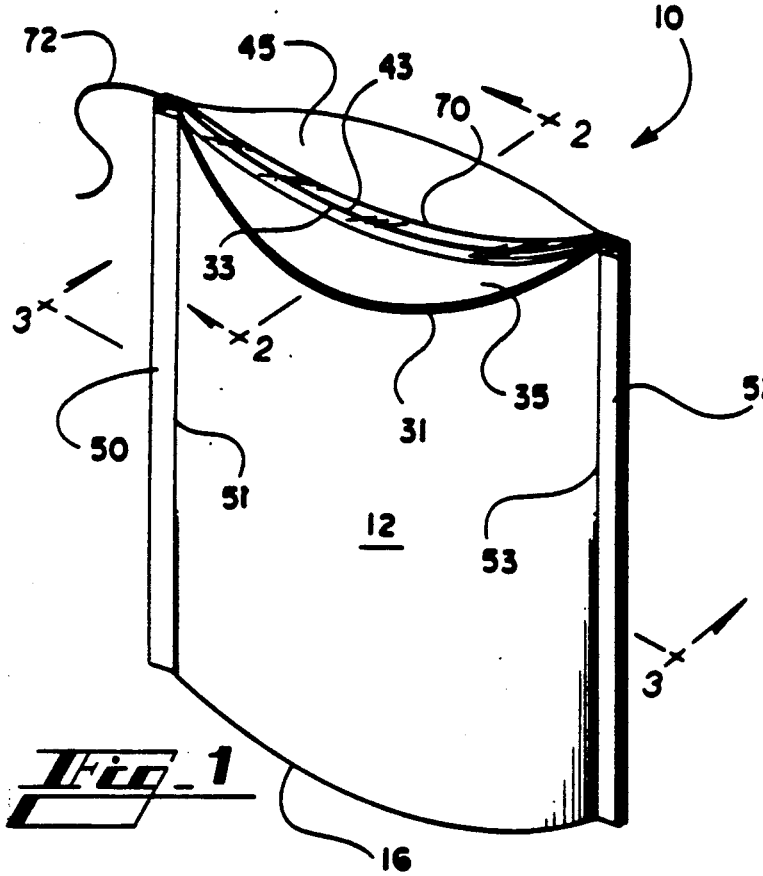
FIG. 1 is a pictorial view of a container embodying the present invention.

Referring now to the drawing, in which like numerals refer to like parts throughout the several views, FIG. 1 shows a container 10 made of paperboard or any appropriate foldable material, embodying an end closure according to the present invention. The first preferred embodiment of the invention is shown in FIGS. 1–8. The container 10 is formed from a flat blank 10′(shown in FIG. 4), which is assembled for shipping and handling into a flat configuration 10″(shown in FIG. 5), which can be erected into the container 10 for loading.

Figure 2:
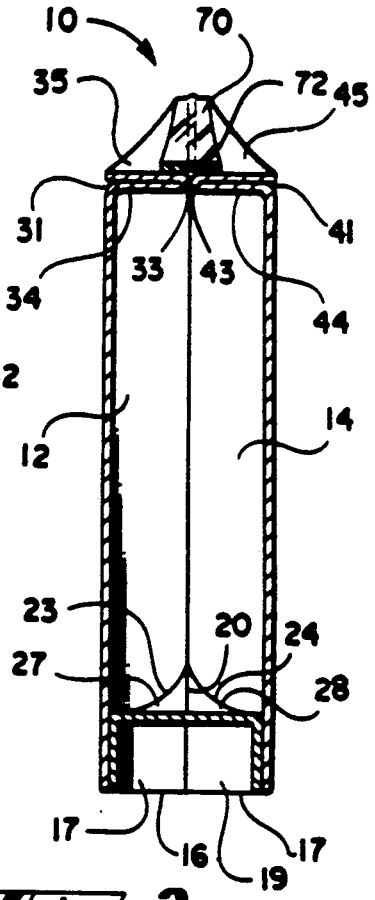
FIG. 2 is a vertical cross-sectional view of the container of FIG. 1, taken along line 2—2.
Figure 3:
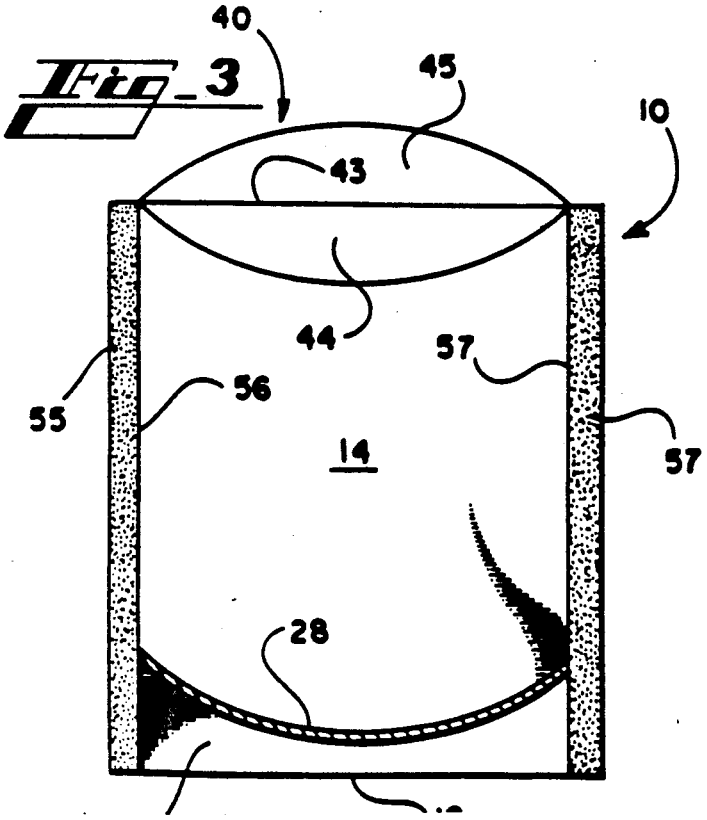
FIG. 3 is a vertical cross-sectional view of the container of FIG. 1, taken along line 3—3, with the end panels shown in the open position.

The container 10 includes a pair of side panels 12 and 14, extending outwardly in a smooth curve and connected by a bottom structure best shown in FIGS. 2 and 3. The side panel 12 is connected along a transverse fold line or score 16 to an inner side panel 17. The side panel 14 is likewise connected along a transverse score 18 to an inner side panel 19. In the preferred embodiment, the inner side panels 17 and 19 are joined along a transverse score 20, although those skilled in the art will understand that the blank 10′ could be oriented differently, for example to place the side panels side-by-side.

Figure 5:
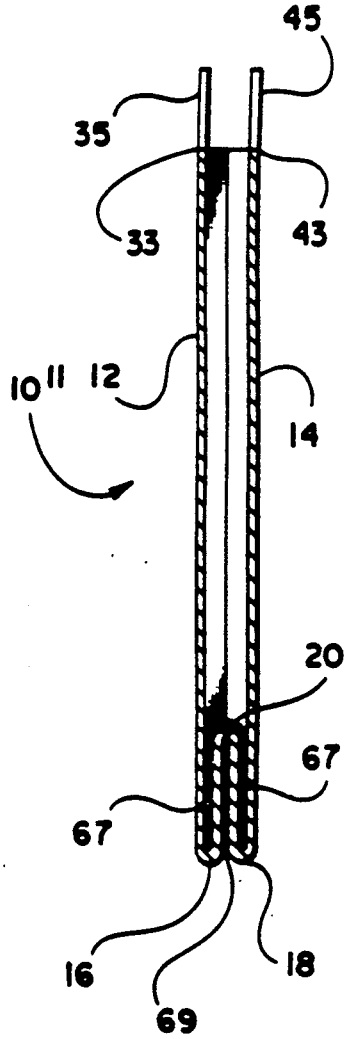
FIG. 5 is a vertical cross-sectional view of an assembled container embodying the invention in a collapsed configuration.

A pair of arcuate scores 23 and 24 are formed in the inner side panels 17 and 19, respectively, defining a pair of semi-elliptical floor panels 27 and 28, separated by the score 20. The arcuate scores 23 and 24 meet at two points 25 and 26 along the score 20, at outer corners of the inner side panels. The arcuate scores 23 and 24 thus generally form an ellipse tapering to corners along its major axis. The inner side panels 17 and 19 are folded up between the side panels 12 and 14 when the collapsed container 10″ of FIG. 5 is formed. When the container is erected, the panels 27 and 28 form an outwardly curved, self-locking floor as shown in FIGS. 2 and 3. Since these panels are recessed inwardly from the transverse scores 16 and 17, the container can rest on the generally elliptical edge formed by the scores 16 and 17 without support.

The upper boundary of the side panel 12 is formed by an arcuate score 31, which connects the panel 12 to a generally elliptical end flap 30. The end flap 30 is divided by a transverse score 33 into semi-elliptical portions, an inner flap panel 34 and an outer flap panel 35. Similarly, the upper boundary of the side panel 14 is formed by an arcuate score 41, which connects the panel 14 to a generally elliptical end flap 40. The end flap 40 is divided by a transverse score 43 into semi-elliptical portions, an inner flap panel 44 and an outer flap panel 45. The significance of the shape of these end flap panels will be described below.

Glue panels are provided for the purpose of joining the side panels 12 and 14 together along their longitudinal edges. Glue panel 50 is connected to the side panel 12 along a longitudinal score 51, and glue panel 52 is connected to the opposite edge of side panel 12 along a longitudinal score 53. Similarly, side panel 14 is connected to glue panels 55 and 57 along longitudinal scores 56 and 58, respectively. Glue panel 60 is connected to inner side panel 17 along a longitudinal score 61, and glue panel 62 is connected to the panel 17 along a longitudinal score 63. Likewise, glue panels 64 and 66 are connected to the inner side panel 19 along longitudinal scores 65 and 68, respectively.

It will be seen from the drawing that longitudinal scores 51, 61, 65 and 56 are colinear, and that associated glue panels 50, 60, 64 and 55 are aligned along one edge of the blank 10′, while scores 53, 63, 68 and 58 are colinear, and glue panels 52, 62, 66 and 57 are aligned along the opposite edge of the blank. Two beads of adhesive 67 are placed on the inner surface of the blank (facing outwardly in FIG. 4), one on panels 50,60,64, and the other on panels 52,62,66. Two other beads of adhesive 69 (one of which is shown in FIG. 5), are placed on the outer surface of the blank, one on panel 60 or 64 and the other on panel 62 or 66.

In order to assemble the blank 10′ into the collapsed form 10″, the glue beads 67 and 69 are placed onto the glue panels as described above using machinery well known in the art. Then the inner side panels 17 and 19 are folded against one another with their outer surfaces contacting and the glue panels 60 and 62 adhering to the glue panels 64 and 66, respectively. The side panels 12 and 14 are folded inwardly along transverse scores 16 and 18 until glue panels 50 and 55 meet each other above the inner side panels 17 and 19, and meet glue panels 60 and 64, respectively, at the level of the inner side panels. Similarly, glue panels 52 and 57 meet each other above the inner side panels 17 and 19, and meet glue panels 62 and 66, respectively, at the level of the inner side panels. Alternately, if the appropriate panels are coated with a thermoplastic, bondable material, the assembly may be heat sealed rather than glued. The container 10″, shown in cross section in FIG. 5, is now ready for erection and loading.

The container 10″ can be erected into the container 10 by placing inward pressure simultaneously on the longitudinal edges of the side panels 12 and 14, and then placing outward pressure on the floor panels 27 and 28 until they lock in the position showing FIGS. 2 and 3. Alternately, pneumatic pressure could be applied internally until the side panels 12 and 14 bow outwardly and the floor panels lock. The upper end of the container 10 now appears as in FIG. 7, with the side panels 12 and 14, as well as the appended end flaps 30 and 40, spaced apart from one another at the center of the container. Solid or loose contents of any type suitable to the strength of the container material may be loaded into the container.

When loading is complete, the container is closed and sealed in the following manner. The outer flap panels 35 and 45 are folded outwardly along scores 33 and 43, while the inner flap panels 34 and 44 are folded inwardly along scores 31 and 41. This folding action results in a configuration as shown in FIGS. 1 and 2, in which the central end flap scores 33 and 43 abut one another across the transverse centerline of the container. They are held in abutting relationship in the first embodiment by a length of adhesive tape 70, which extends at its ends beyond the panels 35 and 45 and is folded onto the surfaces of the glue panels 50,52,55 and 57 to seal the upper end of the container. Optionally, a tear cord 72 may be placed under the center of the tape 70 and allowed to protrude beyond the tape. The cord 72 can be grasped and pulled upwardly to split or remove the tape and unseal the container.

When held in abutting relationship, the folded over end flaps 30 and 40 together form a generally elliptical top which is inwardly bowed and self-locking in a well known manner similar to the floor panels 27 and 28. It would normally be thought to be disadvantageous to close a sealed container with abutting rather than overlapping end flaps. However, an unexpected advantage of the present invention is that the joint to be sealed is a straight line down the center of the top of the container, although the side panels of the container are curved. This centered, linear joint may be sealed more readily than a curved one.

Once the seal is broken, the end flaps can easily be unfolded and brought back to an open configuration as shown in FIG. 7. The contents can be withdrawn or poured from the container. If it is desired to reclose the container, instead of folding each end flap about the central scores 33 and 43, they can be folded across the end of the container in overlapping relation in a conventional manner, as shown in FIG. 8. In such a configuration, the end flaps 30 and 40 bow inwardly and are self-locking. They prevent the side walls from crushing against the remaining contents, and, if the contents are perishable, significantly retard air circulation to help preserve freshness. Of course, the reclosed container of FIG. 8 is not sealed as it was following the initial loading and sealing operation. The container can be opened and reclosed as often as desired.

Figure 6:
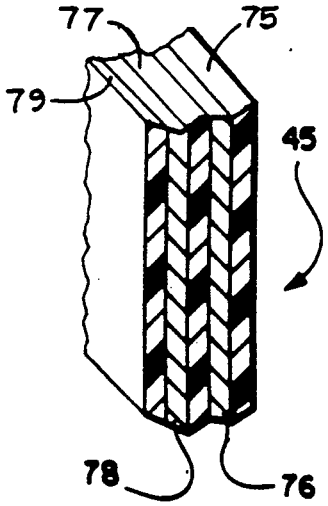
FIG. 6 is a diagrammatic cross-sectional view of a portion of a laminate board used in making the container.
Figure 4:
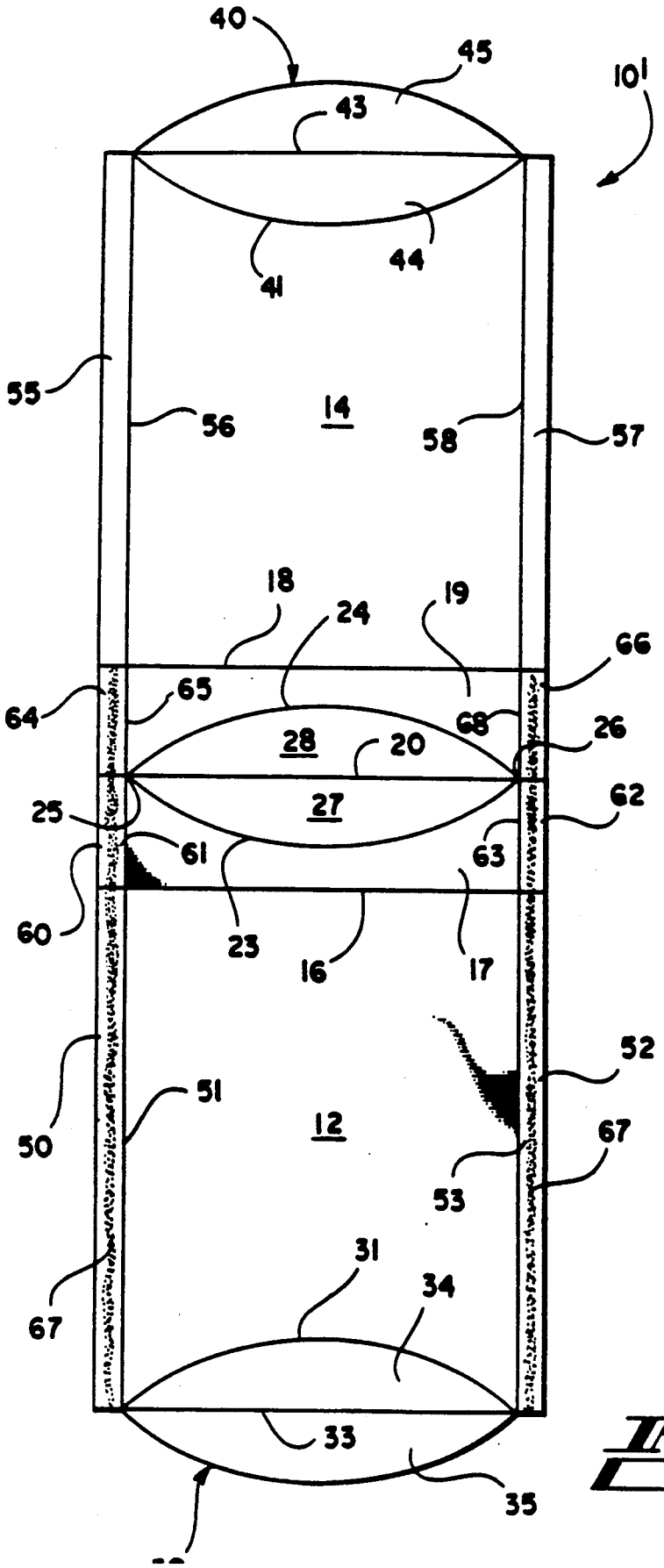
FIG. 4 is a plan view of the inner surface of a blank from which the container of FIG. 1 is constructed.

It should be understood that if a material coated with a thermoplastic material such as that shown in FIG. 6 is utilized for the entire blank 10', the function of the glue beads 67 and 69 in holding together the glue panels 50,60,64,55 and the panels 52,62,66,57 can alternately be accomplished by heat sealing such panels. Of course, this could be done if only the glue panels were coated with thermoplastic material. A sheet material lined only on its interior surface with a thermoplastic material could utilize heat sealing to replace the glue beads 67 while retaining the glue beads 69, thus requiring the application of glue to only one side of the blank and providing a moisture-proof liner.

Another embodiment of the present invention is disclosed as container 100 shown in FIGS. 9 and 10. The structure of the container 100 is similar to that of the container 10 with regard to the side panel and bottom portions. Furthermore, the container 100 can be made from the identical blank 10' shown in FIG. 4.

The container 100 departs from the previous embodiment in the manner in which the end closure is made. When the end flaps 30 and 40 are brought together, they are each folded about fold lines 33 and 43, respectively, but are only folded ninety degrees. The fold lines 33 and 43 again are aligned along the joint. In this configuration, the outer end flap panels 35 and 45 generally lie in the longitudinal plane of the container and engage one another over a major portion of their surface areas. However, because the positioning of the inner flap panels 34 and 44 causes the side panels 12 and 14 to extend outwardly, the outer flap panels 35 and 45 buckle outwardly at the center of the container, at curved portions 102 and 103, respectively. The buckled portions 102 and 103 together form a cone-shaped cavity 104, which tapers downwardly to a sealed point 106 along the joint between the end flaps.

Sealing of the end closure of the container 100 is preferably accomplished in one of two ways. If the container is constructed of a sheet material lined on at least the facing surfaces of the flap panels 35 and 45 with a thermoplastic material, the outer flap panels 35 and 45 may be heat sealed together. Those skilled in the art will understand that a heat sealing jig can be provided capable of urging the outer flap panels together and assuring that the seal extends all along the joint line defined by the scores 33 and 43, including the point 106 below the cavity 104.

Alternately, the end can be sealed by applying adhesive to one of the outer flap panels 35 and 45 and urging them together to seal them together all along the line between the scores 33 and 43.

The container 100 when sealed presents the cavity 104 to the purchaser, who can grasp the sides of the cavity and pull to separate the seal and open the container. The advantageous reclosure features of the container 10 are identical in the container 100. The container 100 when sealed also provides a pleasing and unique appearance when displayed in stores.

FIG. 6 shows diagrammatically a preferred laminate sheet material for construction of the container 10, particularly the outer end flaps. The outer surface 75 of the material is a layer of polyethylene applied to a sheet of paperboard 76. A second layer of polyethylene 77 adheres a sheet of metal foil 78 to the paperboard 76, and a final inner layer 79 of polyethylene is applied to the foil 78. This laminate material is conventional. The inner layer of polyethylene provides a thermoplastic surface suitable for heat sealing.

Figure 11:
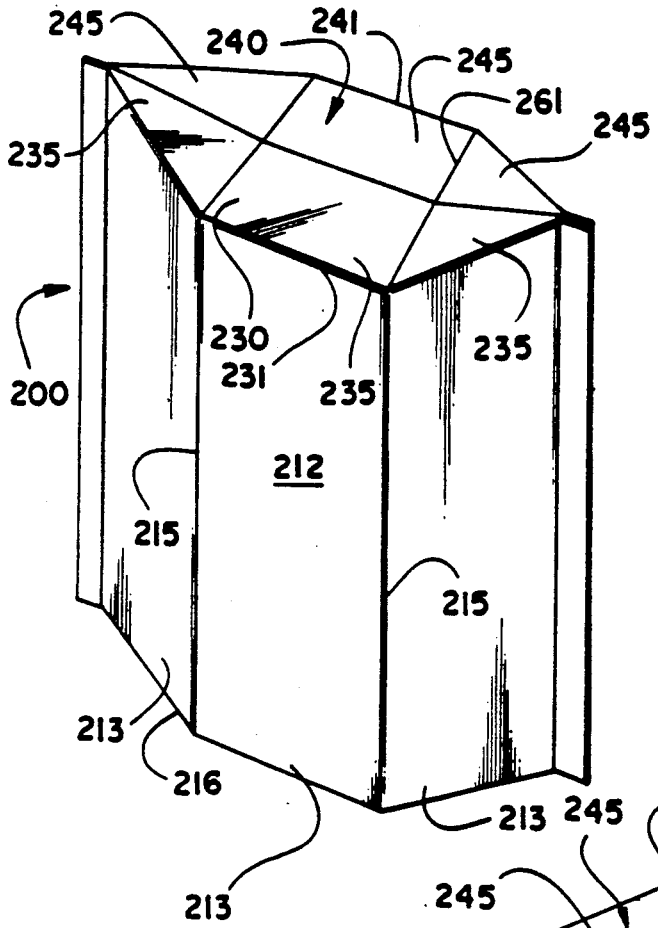
FIG. 11 is a pictorial view of an alternative embodiment of the container, having side panels formed from component panels foldably connected along fold lines extending parallel to the side edges.
Figure 12:
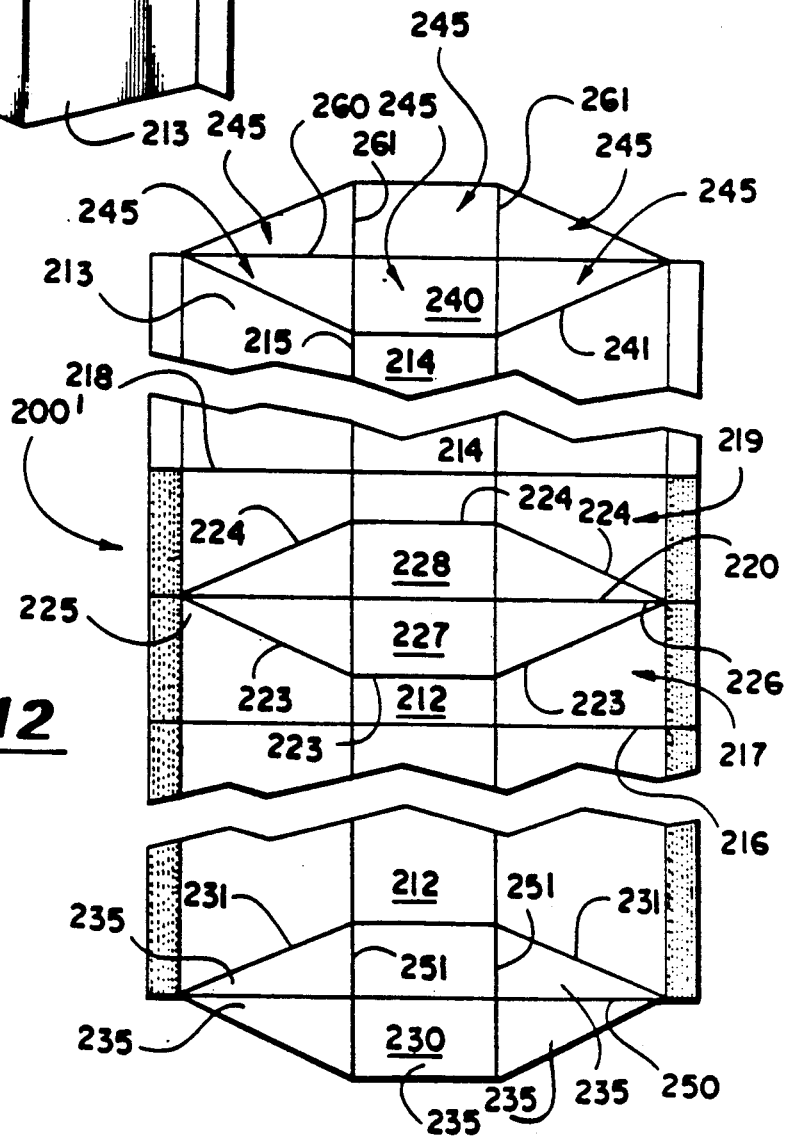
FIG. 12 is a plan view of the inner surface of a blank from which the container of FIG. 11 is constructed.

Another embodiment of the present invention is disclosed as container 200 shown in FIGS. 11, 12 and 13. The container 200 is similar in construction to container 10, but departs from the preferred embodiment in that side panels 212 and 214 are formed from a plurality of component panels 213, foldably connected along fold lines or scores 215. The container 200 is formed from a flat blank 200' (shown in FIG. 12).

In this embodiment, the side panel 212 at its lower edge is connected along a transverse fold line or score 216 to an inner side panel 217. The side panel 214 is likewise connected along a transverse score 218 to an inner side panel 219. The inner side panels 217 and 219 are joined along a transverse score 220. Segmented scores 223 and 224 are formed in the inner side panels 217 and 219, respectively, defining a pair of floor panels 227 and 228, separated by the score 220. The segmented scores 223 and 224 meet at two points 225 and 226 along the score 220, at outer corners of the inner side panels. As will be apparent to one skilled in the art, when the container 200 is erected, the panels 227 and 228 form a self-locking floor similar to that shown in FIGS. 2 and 3.

The upper boundary of the side panel 212 is formed by a segmented score 231, which connects the panel 212 to an end flap 230 formed from a plurality of end panels 235 foldably connected along horizontal fold line 250 and vertical fold lines 251. Similarly, the upper boundary of the side panel 214 is formed by a segmented score 241, which connects the side panel 214 to an end flap 240 formed from a plurality of end panels 245 foldably connected along horizontal fold lines 260 and vertical fold lines 261. As will be apparent to one skilled in the art, vertical fold lines 251 and 261 may be omitted. As will also be apparent to one skilled in the art, sealing of the container 200, shown in FIG. 13, may be accomplished in a similar manner as container 10. Furthermore, the advantageous reclosure features of the container 10 are identical in the container 200.

Furthermore, the number of component panels can be varied. FIGS. 14 and 15 show such a variation, where, a side panel 312 of a container 300 is formed from two component panels 313.

From the foregoing it will be understood that a container according to the present invention is a significant improvement over standard packaging such as pillow-shaped bags. The rigidity of paperboard or similar sheet material protects the contents more than a bag, permits the container to stand on its own, eliminates the need for partitions between individual containers in shipping cartons, and makes filling easy and quick. However, the envelope-style construction of the present container is very conservative in its use of paperboard. As explained above, the end closures provide both an efficient sealing mechanism and a convenient locking reclosure mechanism.

While this invention has been described in detail with particular reference to preferred embodiments thereof, it will be understood that variations and modifications can be effected within the spirit and scope of the invention as described hereinbefore and as defined in the appended claims.

I claim:

1. A container formed of a foldable sheet material, comprising:

a pair of side panels positioned to receive contents therebetween;

a pair of end flaps, one joined to each of said side panels, and each of said end flaps extending from one of said side panels toward said other side panel;

each of said end flaps including a central fold line defining an outer flap panel outwardly of said fold line and an inner flap panel connected to one of said side panels, each one of said outer flap panels being folded back along the central fold line defining each one of said outer flap panels onto the inner flap panel to which it is attached; and means for joining said end flaps together in abutting relationship along said central fold lines with said outer flap panels folded back, whereby the end of said container is sealed.

2. The container of claim 1, wherein said side panels are connected to one another along a pair of side edges, having uppermost ends, said side panels being otherwise spaced apart, and said end flaps are foldably connected to said side panels along fold lines which extend below a plane passing through the uppermost ends of said side edges and normal to said side edges, such that after opening of said container, said end flaps may be folded and locked in place over the end of said container.

3. The container of claim 2 wherein said side panels extend in a smooth curve between said side edges.

4. The container of claim 2 wherein said side panels include a plurality of component panels foldably connected to one another along fold lines extending parallel to said side edges.

5. The container of claim 4 wherein said end flaps are joined to said side panels along edge segments corresponding to said component panels.

6. The container of claim 4 wherein each of said side panels includes at least three adjacent component panels.

7. The container of claim 2, wherein said means for joining said end flaps together comprises a length of tape applied across said abutted end flaps along said central fold lines.

8. The container of claim 2, wherein said means for joining said end flaps together comprises means for adhesively joining said abutting end flaps along said central fold lines.

9. The container of claim 8, wherein each of said end flaps have an inwardly-facing surface, each of said inwardly facing surfaces being lined with a thermoplastic coating.

10. The container of claim 9, wherein said outer panels of said end flaps are heat sealed together over a major portion of their area, leaving a cavity defined between said outer panels at the center of said container end.

11. A container formed of a foldable sheet material, comprising:

a pair of outwardly bowed side panels positioned to meet at corresponding side edges and to receive contents therebetween;

a pair of end flaps one joined to each of said side panels along outwardly and downwardly bowing fold lines and each extending from one of said side panels toward said other side panel;

each of said end flaps including a central fold line, said central fold line defining an outer flap panel outwardly of said central fold line and an inner flap panel connected to one of said side panels, each one of said outer flap panels being folded back along the central fold line defining each one of said outer flap panels onto the inner flap panel to which it is attached; and means for joining said end flaps together in abutting relationship along said central fold lines with said outer flap panels folded back, whereby the end of said container is sealed, and whereby after opening of said container, said end flaps may be folded in and locked in place over the end of said container.

12. The container fo claim 11, wherein said means for joining said end flaps together comprises a length of tape applied across said abutted end flaps along said central fold lines.

13. The container of claim 11, wherein said means for joining said end flaps together comprises means for adhesively joining said abutting end flaps along said central fold lines.

14. The container of claim 13, wherein said end flaps are lined on the inwardly-facing surface thereof with a thermoplastic coating.

15. A container formed of a foldable sheet material, comprising:

a pair of outwardly bowed side panels positioned to meet at corresponding side edges and to receive contents there between;

a pair of end flaps one joined to each of said side panels along outwardly and downwardly bowing fold lines and each extending from one of said side panels toward said other side panel;

each of said end flaps including a central fold line defining an outer flap panel outwardly of said central fold line and an inner flap panel connected to one of said side panels, each one of said outer flap panels being folded back along the central fold line defining each one of said outer flap panels; and means for adhesively joining said outer flap panels of said end flaps, leaving a cavity defined between said outer flap panels suitable to permit grasping of said outer flap panels to open said container.

16. The container of claim 15, wherein said outer panels of said end flaps are lined with a thermoplastic coating, and wherein said means for adhesively joining said outer panels comprises means for heat sealing said outer panels together.

17. A container formed of a foldable sheet material, comprising:

a pair of side panels positioned to receive contents therebetween, said side panels being connected to one another along a pair of side edges, having uppermost ends, said side panels being otherwise spaced apart;

a pair of end flaps, one joined to each of said side panels, and each of said end flaps extending from one of said side panels toward said other side panel, said end flaps being foldably connected to said side panels along fold lines which extend below a plane passing through the uppermost ends of said side edges and normal to said side edges, such that after opening of said container, said end flaps may be folded and locked in place over the end of said container;

each of said end flaps including a central fold line defining an outer flap panel outwardly of said fold line and an inner flap panel connected to one of said side panels, each one of said outer flap panels being folded back along the central fold line defining each one of said outer flap panels onto the inner flap to which it is attached; and means for joining said end flaps together in abutting relationship along said central fold lines with said outer flap panels folded back, whereby the end of said container is sealed.

* * * * *